US008826978B2

(12) United States Patent
Pershikova

(10) Patent No.: US 8,826,978 B2
(45) Date of Patent: Sep. 9, 2014

(54) METHOD OF TESTING THE OPERATION OF A PRODUCING OIL WELL OPERATED USING THE FORMATION HYDROFRACTURING PROCESS

(75) Inventor: Elena Mikhailovna Pershikova, Westhill (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 713 days.

(21) Appl. No.: 12/744,841

(22) PCT Filed: Jun. 10, 2008

(86) PCT No.: PCT/RU2008/000374

§ 371 (c)(1),
(2), (4) Date: Oct. 24, 2010

(87) PCT Pub. No.: WO2009/070050

PCT Pub. Date: Jun. 4, 2009

(65) Prior Publication Data

US 2012/0267096 A1 Oct. 25, 2012

(30) Foreign Application Priority Data

Nov. 30, 2007 (WO) ..... PCT/RU2007/000671

(51) Int. Cl.

| | |
|---|---|
| ***E21B 43/267*** | (2006.01) |
| ***E21B 47/10*** | (2012.01) |
| ***E21B 49/00*** | (2006.01) |
| ***E21B 49/08*** | (2006.01) |

(52) U.S. Cl.

CPC ..... *E21B 47/1015* (2013.01); *E21B 49/08* (2013.01); *E21B 43/267* (2013.01)

USPC ..... 166/250.1; 73/152.23; 166/250.12; 166/264; 166/280.1; 436/27

(58) Field of Classification Search

None

See application file for complete search history.

(56) References Cited

U.S. PATENT DOCUMENTS

| | | | | |
|---|---|---|---|---|
| 6,691,780 | B2 * | 2/2004 | Nguyen et al. | 166/254.1 |
| 6,725,926 | B2 * | 4/2004 | Nguyen et al. | 166/254.1 |
| 7,160,844 | B2 * | 1/2007 | Urbanek | 507/269 |
| 7,933,718 | B2 * | 4/2011 | McDaniel et al. | 702/11 |
| 2003/0006036 | A1 * | 1/2003 | Malone et al. | 166/250.12 |
| 2003/0196799 | A1 * | 10/2003 | Nguyen et al. | 166/250.12 |
| 2003/0196800 | A1 * | 10/2003 | Nguyen et al. | 166/254.1 |
| 2008/0202747 | A1 * | 8/2008 | Gleitman et al. | 166/254.1 |
| 2009/0090505 | A1 * | 4/2009 | McDaniel et al. | 166/250.1 |

FOREIGN PATENT DOCUMENTS

| | | | |
|---|---|---|---|
| EA | 200601872 | A1 | 2/2007 |
| RU | 2171888 | | 8/2001 |
| RU | 2006101982 | A | 8/2006 |
| SU | 977726 | | 11/1982 |
| SU | 1017794 | | 5/1983 |

* cited by examiner

*Primary Examiner* — George Suchfield

(74) *Attorney, Agent, or Firm* — Rachel E. Greene; Tim Curington

(57) ABSTRACT

This invention relates to oil production, more specifically, oil production using the formation hydrofracturing process, and can be used for monitoring the operation of a producing oil well.

7 Claims, No Drawings

METHOD OF TESTING THE OPERATION OF A PRODUCING OIL WELL OPERATED USING THE FORMATION HYDROFRACTURING PROCESS

This application claims priority as a 35 U.S.C. §371 national phase application of International Patent Application No. PCT/RU08/00374, filed Jun. 10, 2008 which is incorporated by reference herein in its entirety.

This invention relates to oil production, more specifically, oil production using the formation hydrofracturing process, and can be used for monitoring the operation of a producing oil well.

Known is (RU Patent 217888) a method of monitoring the leak tightness of the annular space. According to the known method, the space outside the casing string is filled with a grouting mortar containing gaseous chemically inert radioisotopes, following which background gamma logging is carried out after the cement stone formation and then with preset time intervals to mark the start time of behind-the-casing flow by comparing the test gamma logging results with the background one, wherein said radioisotope is a long-lived gaseous chemically inert radioisotope with monochromatic gamma radiation having no short-lived fission products, and is introduced directly into the grouting mortar. It is typically recommended to use the Krypton 85 radioisotope with a half-life of 10.71 years and 0.5 MeV monochromatic gamma radiation without short-lived fission products.

Disadvantage of the known method is the lack of information on oil release by the formation.

Known is (SU Inventor's Certificate 977726) a method of monitoring the development of an oil/gas field. According to the known method, the monitoring is with a marker preliminarily injected into the producing formation, said marker being at least one fluorocarbon compound. Quantitative and qualitative characterization of the well operation is carried out using nuclear-magnetic resonance spectroscopy.

Disadvantage of the known method is the lack of information on which exactly part of the formation releases hydrocarbons and the use of a complex analytical instrument, i.e. a nuclear-magnetic resonance spectroscope.

Known is (SU Inventor's Certificate 1017794) a method of monitoring oil flowing in the formation. According to the known method, the marker with the carrier is injected into the formation through injection wells, samples are taken from production wells, and the presence and showing time of the marker with the carrier is marked, wherein said carrier includes some fractions of the oil taken from the formation being tested, for example, the 40-230° C. boiling point oil fraction. Judgment on oil flowing in the formation is made based on the quantity of the marker taken with the samples.

Disadvantage of the known method is its relatively high cost because it requires rectifying the produced oil either in site thus making necessary an in-site rectifier or off-taking the required fraction at a distillery. Moreover, the known method does not allow determining the productivity of specific areas of a productive formation.

The technical objective that can be achieved using the technical solution developed herein is to provide for efficient monitoring of the development status of a hydrocarbon reservoir formation.

The technical result that can be achieved by implementing the technical solution developed herein is to increase the accuracy of monitoring oil flow in a formation and the well yield.

Said technical result can be achieved by using the method of testing the operation of a producing oil well operated using the formation hydrofracturing process. According to said method, at least two hydraulic fractures are produced in the formation using any known method, said fractures are filled with particles of a proppant containing the slag of various metallurgical production that in turn contains various metals as the main impurity in the slag particles, and the oil/water/gas mixture is samples from the well, wherein said mixture contains proppant particles, including slag particles carried out from the fracture. The proppant particles are separated using any known liquid/solid phase separation method, and the concentration of metals in the slag particles is determined. The results are used for judging on which fractures provide for oil inflow from the formation to the well.

If two hydraulic fractures are produced in a formation, then slag particle containing proppant is only injected into one of these fractures. The reason is that the absence of impurity metal contained in the slag particles in the well product (the oil/water/gas mixture) makes it evident that the oil is released by the other fracture. If there are three or more fractures in a formation, slag particles with impurities of three different metals should be injected into the formations with the proppant. To ensure better fixing of the slag particles in the hydraulic fracture, slag particles with parameters close to those of the proppants are preferably used.

The mechanism of the method is as follows.

After a hydraulic fracture is produced in a reservoir formation, a pipe is lowered into the well the on-ground end of this pipe being connected to the proppant particle containing suspension delivery device and the other end being opposite one of the fractures, preferably the lowermost one, and the proppant particle containing suspension is injected into the fracture to prevent fracture closing (this is a standard well processing method if hydrofracturing is used). However, along with the proppant particles, the suspension contains metallurgical slag particles in which an impurity is the metal the production of which forms said slag as a waste. Then the end of the pipe is directed to another earlier formed hydraulic fracture and the proppant particle containing suspension is injected into the fracture, but this time the suspension contains metallurgical slag particles of another metallurgical production and hence with another metal as an impurity. Similarly, slag particles containing impurities of different metals are injected into each hydraulic fracture produced in the formation. Then the well so prepared is put into operation. The oil/water/gas mixture released by the well is passed through the solid phase separator. The separated solid phase contains proppant particles and slag particles. The solid phase so collected is analyzed for the content of metals used as hydraulic fracture markers. As a result, the hydraulic fractures that provide for the oil inflow into the well (large quantity of a respective metal marker in the solid phase) and that provide for but minor oil inflow (no metal marker in the solid phase) are determined. These results allow judging on the necessity of either cleaning the non-producing formation zone from gels and other pollutants that prevent oil outflow or producing more hydraulic fractures. The latter activity usually leads to the activation of a hydraulic fracture and increasing the yield of a production well.

Advantages of this method are its relatively low cost provided for by the use of production waste (metallurgical slag) and the low price of the additional equipment required, i.e. a membrane filter or a hydraulic cyclone for liquid/solid phase separation and simple analytical equipment for the detection of known metals in the separated solid phase, such as a kit of ion-selective electrodes or equipment for drop chemical analysis (water or acid extraction aliquot titration methods, depending on the metals to be tested).

Further herein the method will be illustrated with an example of its implementation at a well operated by Schlumberger Technological Company in Western Siberia.

4 hydraulic fractures were made in a 16 m thick producing formation using a standard method. Then, using typical equipment for filling hydraulic fractures with proppant particles, the lowermost fracture, along with spheroid ceramic proppant particles in the form of 6-100, preferably 10-40 mesh sized granules with a Crumbain sphericity and roundness of at least 0.8 and a density of 2.6 g/cm$^3$ was filled with copper containing slag particles crushed to roughly the same size, the second hydraulic fracture, along with said proppant particles was filled with lead containing slag particles, the third fracture was filled with iron containing particles and the four fracture was filled with zinc containing particles. After the hydraulic fractures were filled with slag and proppant particles acting as the carrier with the marker, the oil/water mixture was pumped out from the well using submergible pumps. The mixture was periodically passed through the hydraulic cyclone for solid phase separation. The separated solid phased was further separated by specific weight into fractions one of which consisted of slag particles. The slag particles were cleaned from oil, crushed and exposed to sulfuric acid. The acid extraction was analyzed with ion-selective electrodes for the content of copper, lead, iron and zinc ions. The acid extraction contained copper and zinc ions and residual quantities of iron and lead ions. Thus, the second and third fractures release little if any oil. The well operation was suspended, the zones of the second and third fractures were washed with a gel destruction solution and then with a filtration crust dissolving solution. Then the second and third fractures were again filled with proppant mixed with iron and lead containing slag particles, respectively, and oil production from the well was resumed. Repeated analysis of the solid phase separated from the oil/water mixture showed all the four metal ions. The well yield increased by 22%.

What is claimed is:

1. Method of testing the operation of a producing oil well operated using the formation hydrofracturing process comprising the steps of injecting a marker with a carrier into the formation, sampling from the production well and determining the presence and quantity of the marker with further judgment on the productivity of formation zones in the well wherein at least two hydraulic fractures are preliminarily produced in the formation, and using slag particles of various metallurgical production with proppant placed into the at least two hydraulic fractures, each fracture being filled with slag particles containing a different metal as the marker.

2. Method according to claim 1, wherein spheroid shaped slag particles are used.

3. A method of testing the operation of an oil well having a plurality of fractures, comprising:

placing into a first fracture proppant mixed with slag particles having a first metal;

placing into a second fracture proppant mixed with slag particles having a second metal;

producing an oil mixture from the oil well; and analyzing the oil mixture produced from the oil well to determine the content of the first metal and the second metal as an indicator of production from the first fracture and the second fracture, respectively.

4. The method as recited in claim 3, wherein placing into the first fracture comprises placing into a lower fracture.

5. The method as recited in claim 3, further comprising placing into a third fracture proppant containing slag particles having a third metal.

6. The method as recited in claim 5, further comprising placing into a fourth fracture proppant containing slag particles having a fourth metal.

7. The method as recited in claim 3, further comprising cleaning the slag particles from the oil mixture for analysis by creation of an acid extraction.

* * * * *